US006211474B1

(12) United States Patent
Takahashi

(10) Patent No.: US 6,211,474 B1
(45) Date of Patent: Apr. 3, 2001

(54) MULTI-INPUT SWITCH

(75) Inventor: Kisaburo Takahashi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/442,933

(22) Filed: Nov. 18, 1999

(30) Foreign Application Priority Data

May 12, 1997 (JP) ..... 9-121048

(51) Int. Cl.[7] ..... H01H 3/00
(52) U.S. Cl. ..... 200/18; 200/553
(58) Field of Search ..... 200/417, 6 A, 200/543–545, 564, 553, 557, 558, 559, 561, 339, 567, 568, 569, 572, 336

(56) References Cited

U.S. PATENT DOCUMENTS 4,175,220 * 11/1979 Johnston et al. ..... 200/4
4,201,899 * 5/1980 Owen ..... 200/153 R
4,255,633 * 3/1981 Johnston et al. ..... 200/153 J
5,448,240 9/1995 Morito .
5,459,292 * 10/1995 Nagano et al. ..... 200/5 R
5,613,600 * 3/1997 Yokoji et al. ..... 200/564
5,705,778 * 1/1998 Matsui et al. ..... 200/11 R
5,847,335 * 12/1998 Sugahara et al. ..... 200/4
5,886,310 * 3/1999 Kataoka et al. ..... 200/14
6,049,044 * 4/2000 Mizobuchi ..... 200/4
6,124,555 * 9/2000 Isikawa ..... 200/4

* cited by examiner

*Primary Examiner*—Lincoln Donovan
*Assistant Examiner*—Nhung Nguyen
(74) *Attorney, Agent, or Firm*—Brinks Hofer Gilson & Lione

(57) ABSTRACT

A multi-input switch according to the present invention, the rotatively-operated electronic component is arranged in a direction of the rotation axis of an operation member while switches are arranged in the direction perpendicular to it. By the rotational movement of the operation member, the rotatively-operated electronic component is operated via the shaft member while by the perpendicular movement of the operation member, the shaft is tilted to operate the switches, so that the entire rotatively-operated electronic component does not move to improve the space-saving factor enabling the switch to be miniaturized.

5 Claims, 9 Drawing Sheets

MULTI-INPUT SWITCH

BACKGROUND OF THE INVENTION

1. Field of the Invention

The present invention relates to a multi-input switch which is suitable for use in radios, CD recorders, and navigation systems for automobiles, for example.

2. Description of the Related Art

There is a conventional multi-input switch disclosed in U.S. Patent Publication No. 5,613,600.

As shown in FIGS. 8 to 11, in the multi-input switch, a rotatively-operated component "R" is operated by the rotation of an operation knob "S" while a push-switch "P" is operated by the movement of the operation knob "S" in a direction perpendicular to the axis of the operation knob "S".

The rotatively-operated component "R" is formed such that a rotary member 53 thereof is rotatably attached through a shaft 54 to a box-shaped casing 51 to which a contact member 50 having a pair of resilient contact arms 50*a* and 50*b* is fixed. A contact plate 52 sliding in contact with the resilient contact arm 50*a* in the box-shaped casing 51 is fixed to the rotary member 53.

The push-switch "P" is formed such that a contact portion (not shown) is arranged within a cage 55 to which an operation button 56 is movably attached.

As shown in FIG. 11, a flat-plate-shaped insulating base plate 58 comprises a recess portion 58a for guiding the rotatively-operated component "R", a pair of guide rails 58*b* for preventing the rotatively-operated component "R" from coming off disposed on both sides of the recess portion 58*a*, and a recess portion 58*c* and a protruded portion 58*d*, each spaced from the recess portion 58*a*.

Furthermore, in the insulating base plate 58, fixed terminals 59 are embedded in an exposed state in the recess portion 58*a*.

The rotatively-operated component "R" is attached to the insulating base plate 58; the casing 51 of the rotatively-operated component "R" is placed on the recess portion 58*a* of the insulating base plate 58, the guide rails 58*b* are urged in contact with step portions 51*a* of the casing 51, and the casing 51 is elastically pressed by a torsion coil spring 60 supported by the protruded portion 58*d*.

When the rotatively-operated component "R" is attached, the resilient contact arm 50*b* is in contact with contacts 59*a* exposed on the insulating base plate 58.

The push-switch "P" is attached to the insulating base plate 58; the cage 55 of the push-switch "P" is fitted into the recess portion 58*c* on the insulating base plate 58, and the operating button 56 opposes a protruded portion 51*b* of the casing 51 of the rotatively-operated component "R".

Furthermore, the operation knob "S" is attached to the rotary member 53 of the rotatively-operated component "R" by a screw 61.

The operation of the conventional multi-input switch will now be described; when the operation knob "S" is rotated, the rotary member 53 rotates about the shaft 54 in accordance with the rotation, the contact plate 52 attached to the rotary member 53 also rotates to be contacted with and separated from the resilient contact arm 50*a* for switching the contact, the switching is derived via the resilient contact arm 50*b* and the contact 59*a* to the fixed terminal 59.

Next, when the operation knob "S" is pushed in the direction perpendicular to the axis of the shaft 54, i.e., the direction indicated by the arrow "Y", the operation knob "S" moves in the direction of the arrow "Y" against the torsion coil spring 60 accompanying the rotatively-operated component "R".

At this time, in the state that the electrical connection of the rotatively-operated component "R" is maintained, i.e., the resilient contact arm 50*b* is sliding on the contact 59*a* of the fixed terminal 59, the protruded portion 51*b* of the casing 51 pushes the operation button 56 of the push-switch "P".

Thus, the contact of the push-switch "P" is switched, and then when the pressing is relieved, the rotatively-operated component "R" returns to the original position accompanying the operation knob "S" owing to the torsion coil spring 60.

At this time, in the state that the electrical connection of the rotatively-operated component "R" is maintained, i.e., the resilient contact arm 50*b* is sliding on the contact 59*a* of the fixed terminal 59, the operation button 56 returns to the original state, so that the contact of the push-switch "P" is switched.

In this manner, the rotatively-operated component "R" is operated by the rotation of the operation knob "S" while the push-switch "P" is operated by the movement of the operation knob "S" in the direction perpendicular to the axis.

The conventional multi-input switch involves a problem that the size thereof is large because the rotatively-operated component "R" moves when the operation knob "S" is moved in the direction perpendicular to the axis.

Also, in order to maintain the electrical connection of the rotatively-operated component "R" when the rotatively-operated component "R" is moved, it is required that the resilient contact arm 50*b* slide on the contact 59*a* of the fixed terminal 59, so that the elongation of the component life is difficult and the manufacturing cost is increased due to the complicated structure.

Furthermore, since two components, i.e., the rotatively-operated component "R" and the push-switch "P", are operated by the operation knob "S", there is another problem that numerous switches cannot be switched.

SUMMARY OF THE INVENTION

In order to solve the above-mentioned problems, in accordance with a first aspect of the present invention, there is provided a multi-input switch comprising: an operation member rotatable and movable in a substantially perpendicular direction to a rotation axis of the operation member; a rotatively-operated electronic component arranged in the direction of the rotation axis of the operation member; a first switch arranged in the direction perpendicular to the rotation axis of the operation member; and a shaft member inserted into a center potion of the operation member to be retained in a retaining portion of the operation member or a shaft member retained at a center portion of an operation member while one end portion of the shaft member is retained in a rotational body of the rotatively-operated electronic component, wherein the rotatively-operated electronic component is operated via the shaft member by the rotational movement of the operation member and the first switch is operated by the perpendicular movement of the operation member, and wherein the shaft member is tiltable about the one end portion retained in the rotational body of the rotatively-operated electronic component as a supporting point.

In accordance with another aspect of the present invention, there is provided a multi-input switch comprising: an operation member having a through-hole formed so that the both sides of a retaining portion of the through-hole are conical-shaped, the operation member being rotatable and movable in a substantially perpendicular direction to a rotation axis of the operation member and also being tiltable about the retaining portion of the through-hole; a rotatively-operated electronic component arranged in the direction of the rotation axis of the operation member; a plurality of switches arranged so as to oppose the operation member in the direction perpendicular to the rotation axis of the operation member; a shaft member inserted into the through-hole of the operation member to be retained in the retaining portion while one end portion of the shaft member is retained in a rotational body of the rotatively-operated electronic component, wherein the rotatively-operated electronic component is operated via the shaft member by the rotational movement of the operation member and any one of the plurality of switches is operated by the perpendicular movement of the operation member, and wherein another one of the plurality of switches is operated by the tilting movement of the operating member.

With these features, a multi-input switch may further comprise a driving member disposed between the operation member and the first switch, the driving member being movable by the perpendicular movement of the operation member, wherein the first switch is operated via the driving member.

With these features, a multi-input switch may further comprise a case having an elongated groove, wherein the other end portion of the shaft member is inserted into the elongated groove of the case to be supported.

A multi-input switch may further comprise returning means for returning the movement of the driving member while the operation member being held by the driving member.

DESCRIPTION OF THE PREFERRED EMBODIMENT

Figure 1:
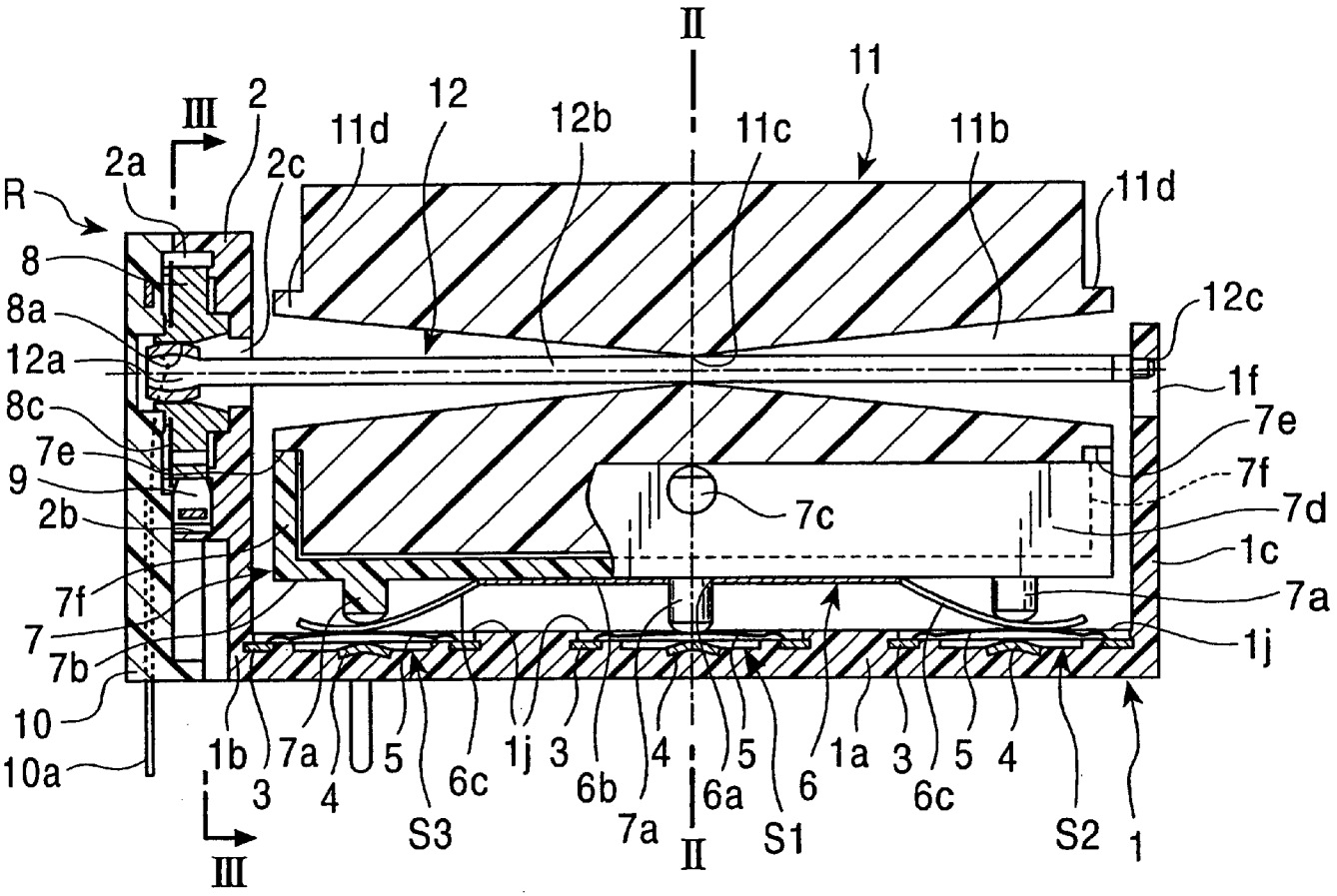
FIG. 1 is a front sectional view of the essential part of a multi-input switch according to the present invention.
Figure 2:
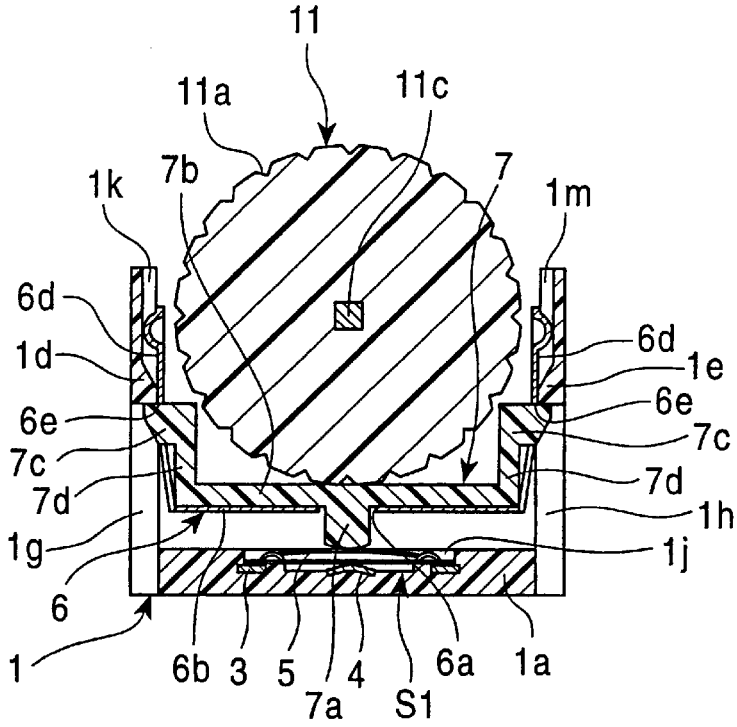
FIG. 2 is a cross-sectional view at the line II—II of FIG. 1.
Figure 3:
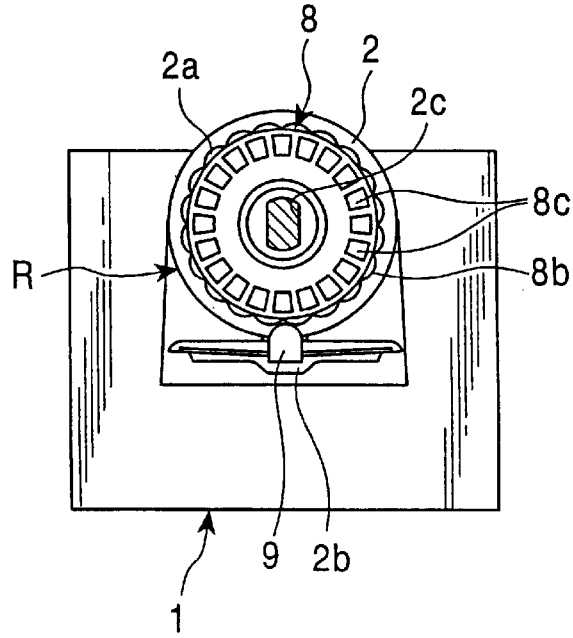
FIG. 3 is a cross-sectional view at the line III—III of FIG. 1.
Figure 4:
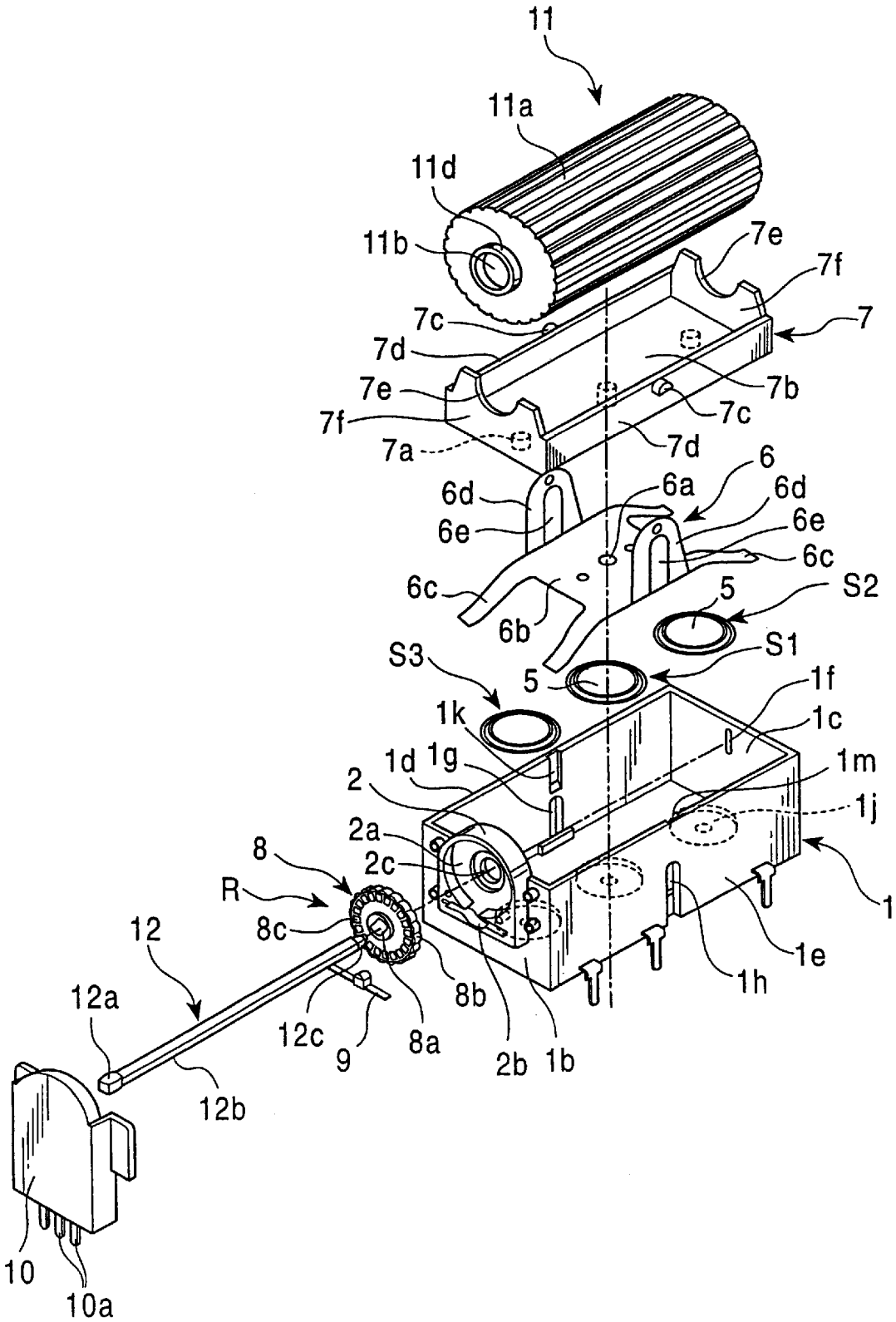
FIG. 4 is an assembly view of the multi-input switch according to the present invention.
Figure 5:
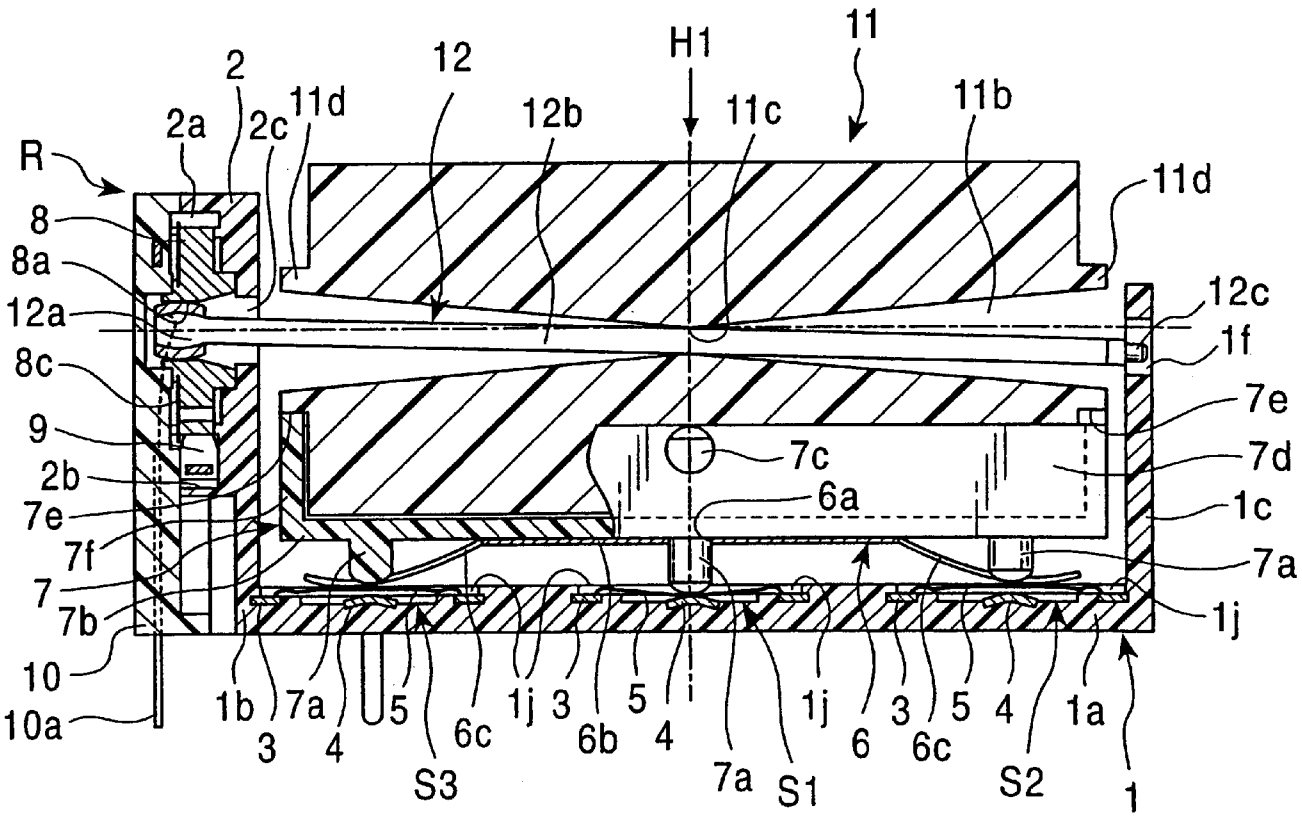
FIG. 5 is a front sectional view in the essential part for illustrating operations of the multi-input switch according to the present invention.
Figure 6:
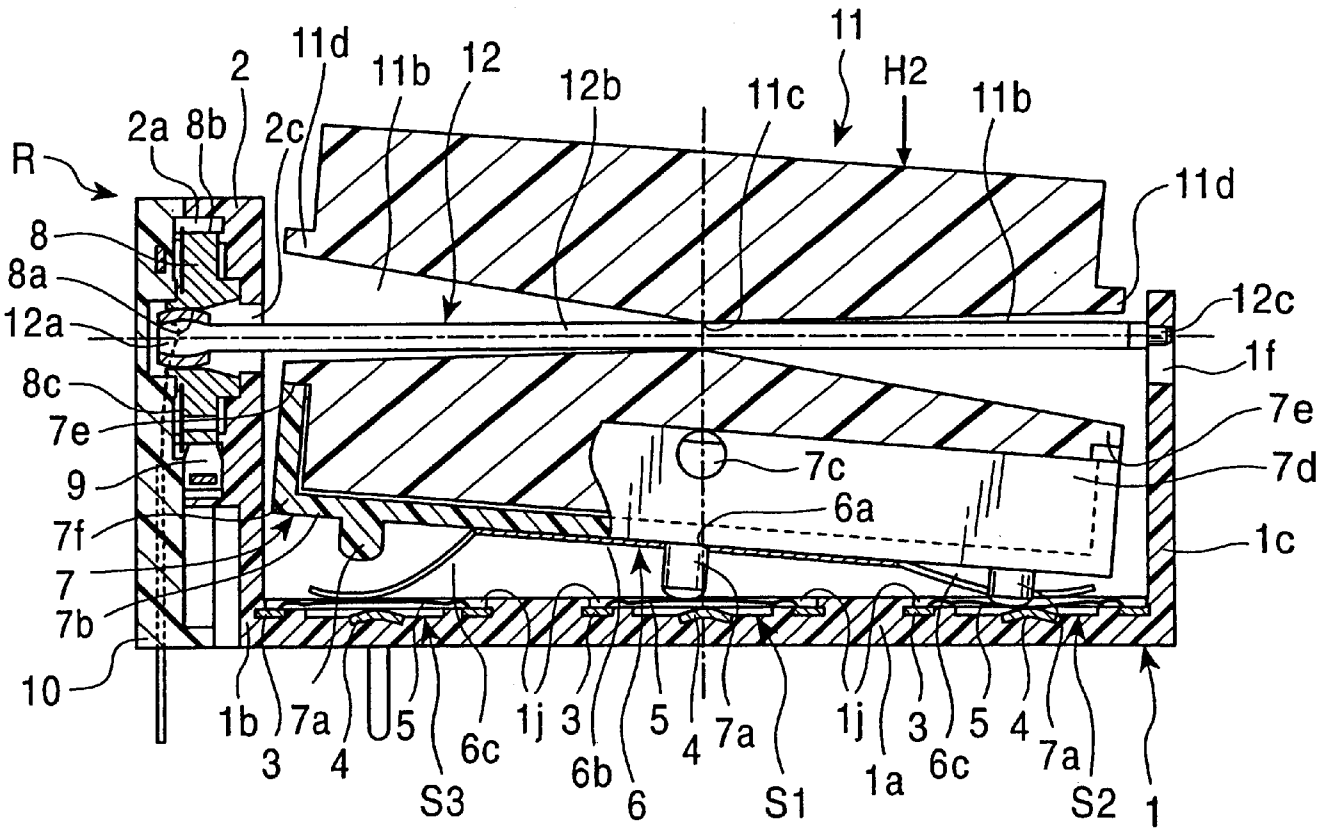
FIG. 6 is a front sectional view in the essential part for illustrating operations of the multi-input switch according to the present invention.
Figure 7:
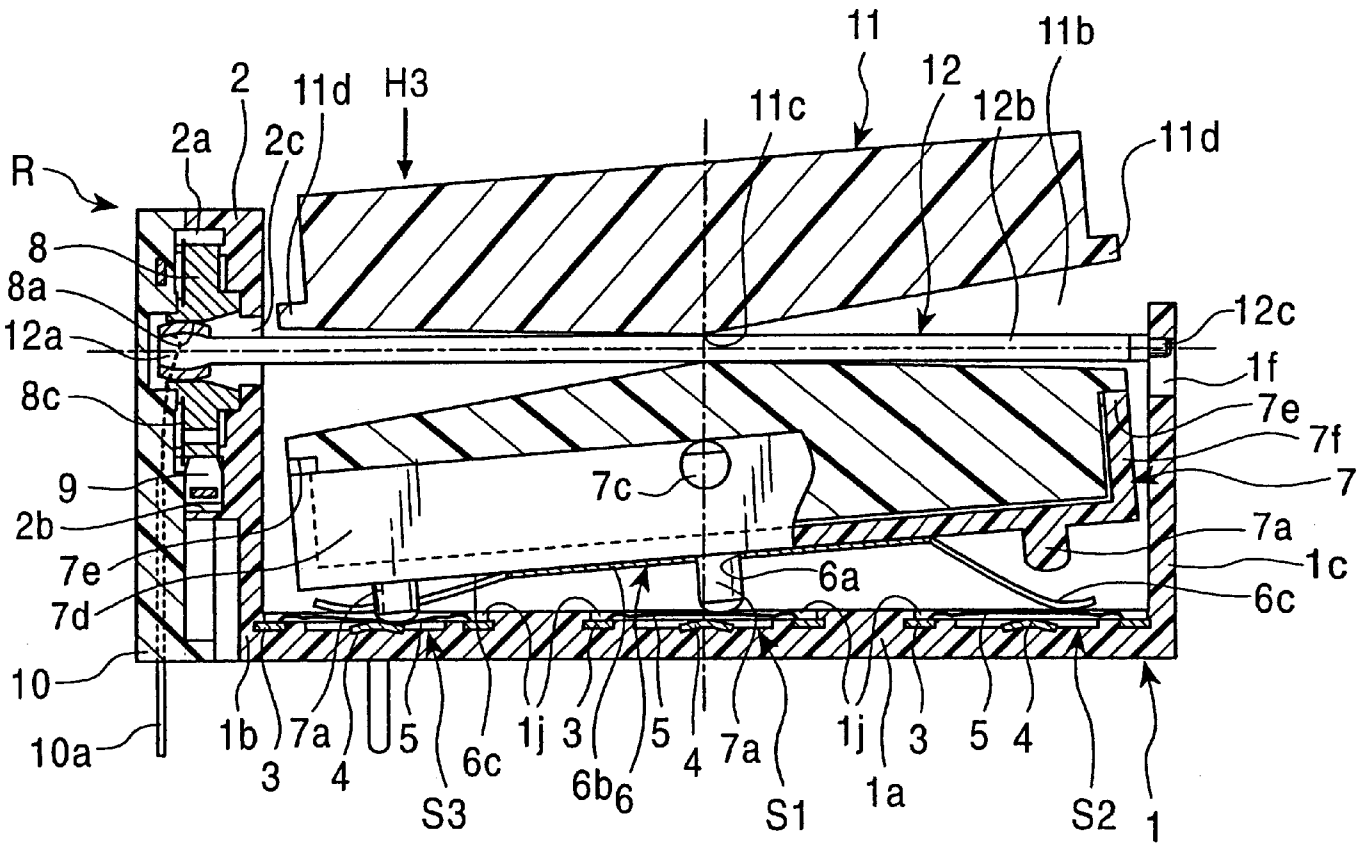
FIG. 7 is a front sectional view in the essential part for illustrating operations of the multi-input switch according to the present invention.
Figure 8:
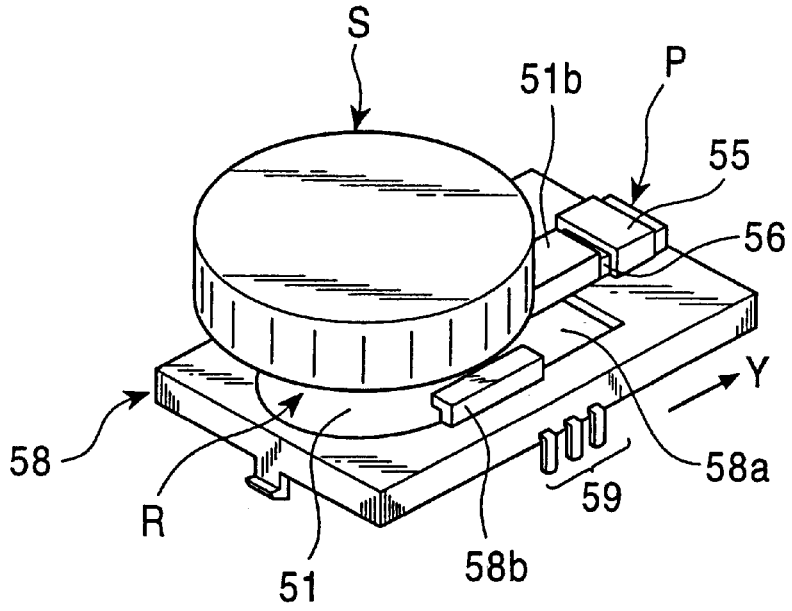
FIG. 8 PRIOR ART
FIG. 8 is a perspective view of a conventional multi-input switch.
Figure 9:
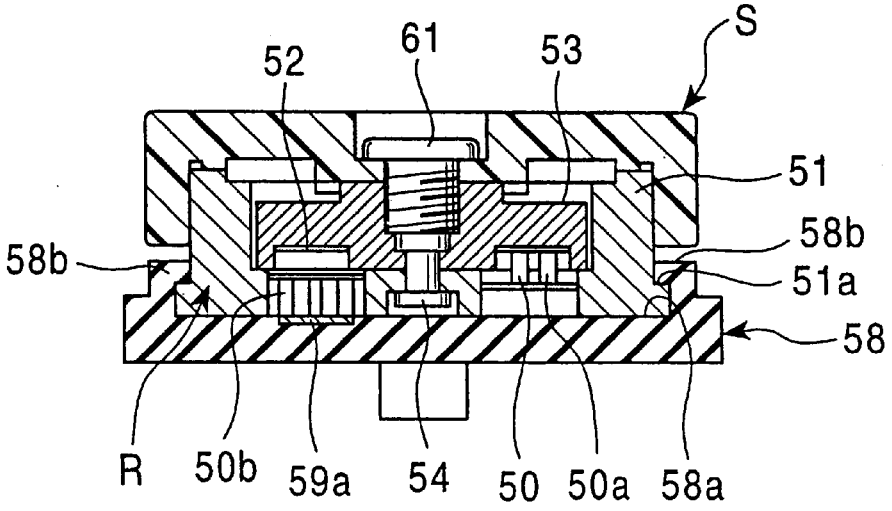
FIG. 9 PRIOR ART
FIG. 9 is a sectional view of the essential part of the conventional multi-input switch.
Figure 10:
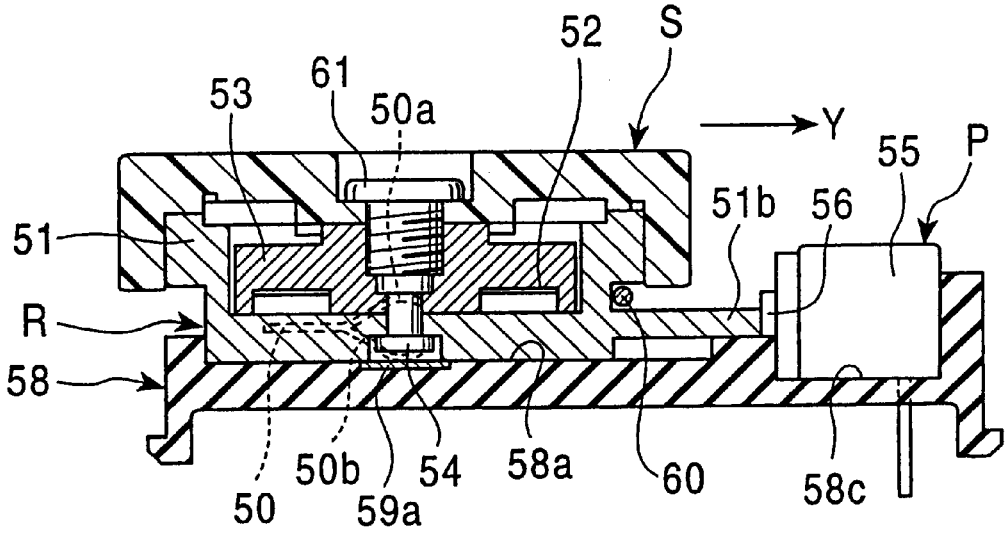
FIG. 10 PRIOR ART
FIG. 10 is a sectional view of the essential part of the conventional multi-input switch.
Figure 11:
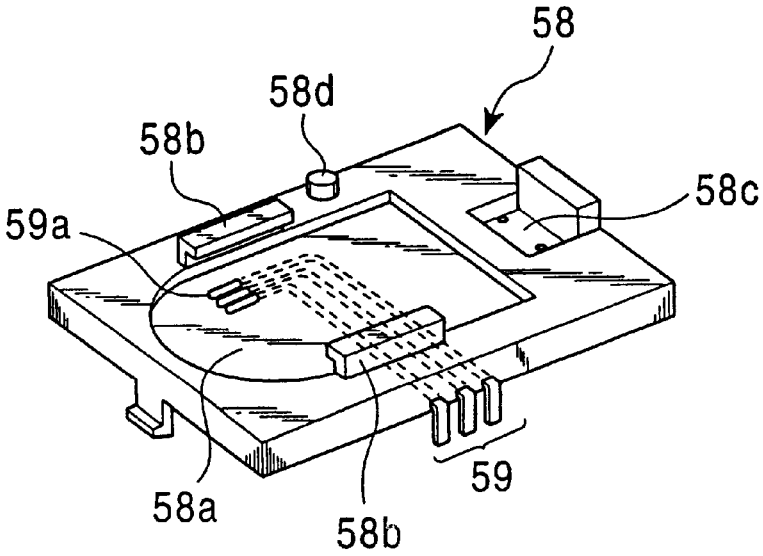
FIG. 11 PRIOR ART
FIG. 11 is a perspective view of an insulating base plate according to the conventional multi-input switch.

A multi-input switch according to the present invention will now be described with reference to FIGS. 1 to 7. FIG. 1 is a front sectional view of the essential part of the multi-input switch according to the present invention. FIG. 2 is a cross-sectional view at the line II—II of FIG. 1. FIG. 3 is a cross-sectional view at the line III—III of FIG. 1. FIG. 4 is an assembly view of the multi-input switch according to the present invention. FIGS. 5 to 7 are front sectional views in the essential part for illustrating operations of the multi-input switch according to the present invention.

A synthetic-resin-molded, top-opened, box-shaped case 1 has a rectangular bottom wall 1*a* and four side-walls 1*b*, 1*c*, 1*d*, and 1*e* extended upwardly from edges of the bottom wall 1*a*.

In the case 1, a cage 2 integrated with the side-wall 1*b* is formed. The cage 2 includes, a circular recess portion 2*a*, an accommodating portion 2*b* connected to the recess portion 2*a*, and a hole 2*c* disposed in the center of the recess portion 2*a*.

Furthermore, in the case 1, an elongated hole if is formed on the side-wall 1*c* opposing the side-wall 1*b* so as to oppose the hole 2*c*. In the center portions of the sidewalls 1*d* and 1*e* which oppose each other, retaining portions 1*g* and 1*h* are formed by elongated holes are formed, respectively as well as grooves 1*k* and 1*m*, respectively.

On the bottom wall 1*a*, three switches S1, S2, and S3 formed of push switches of the same structure are spaced in a row.

In each of these switches S1, S2, and S3, as shown in FIGS. 1 and 4, an annular fixed contact 3 and a contact 4 in the center are embedded in the bottom wall 1*a* and a dome-shaped movable contact formed of a metal spring plate is arranged in a recess portion 1*j* of the bottom wall 1*a*. The periphery of the movable contact 5 is urged into contact with the fixed contact 3 while the center portion of the movable contact 5 is formed to oppose the contact 4. The fixed contact 3 and the movable contact 5 are capable of being connected to the outside by extending terminals integrated with the respective contacts.

The movable contact 5 embedded in the recess portion 1*j* is held therein by sticking it with the bottom wall 1*a* by an adhesive tape (not shown) so as to cover the top surface thereof, for example.

When the case 1 serves as cases of the switches S1, S2, and S3 in common in the bottom wall la in this manner, the number of parts is reduced so as to reduce the cost. However, the switches S1, S2, and S3 may be unitized by assembling them in a separate case.

As shown in FIG. 4, H-shaped returning means 6 formed of a metal plate comprises a rectangular plate portion 6*b* having a hole 6*a*, spring portions 6*c* formed in the four corners of the plate portion 6*b* being bent downwardly, and a pair of arm portions 6*d* being bent upwardly from the center of both sides of the plate portion 6*b*, each arm portion 6*d* having an opening 6*e*.

A synthetic-resin-molded driving member 7 comprises a rectangular bottom wall portion 7*b* having three protruded portions 7*a* protruding downwardly, a pair of side wall portions 7*d* extending upwardly from the longitudinal edges of the bottom wall portion 7*b*, each side wall portion 7*d* having a protruded portion 7*c* in the outside thereof, and a pair of side wall portions 7*f* extending upwardly from lateral edges of the bottom wall portion 7*b* having arc-shaped bearing portions 7*e* in the top portions thereof.

The driving member 7 is fitted into one between the pair of arm portions 6*d* of the returning means 6 so that the bottom wall portion 7*b* lies on top of the plate portion 6*b* of the returning means 6.

Thereby, the protruded portions 7*c* of the driving member 7 proceed downwardly extending the pair of arm portions 6*d* outwardly by force. When the protruded portions 7*c* agree with the openings 6*e* and the arm portions 6*d* return to the original state by its springing properties, the protruded portions 7*c* are inserted and retained in the openings 6*e*, so that the driving member 7 is combined with the returning means 6.

At this time, the plate portion 6*b* of the returning means 6 is urged in contact with the bottom wall portion 7*b* of the driving member 7 and the rather longish protruded portion 7*a* in the center of the bottom surface of the driving member 7 penetrates the hole 6*a* of the returning means 6 to protrude downwardly, while the two protruded portions 7*a* on both sides of the bottom surface of the driving member 7 protrude downwardly from between the spring portions 6*c*.

The returning means 6 and the driving member 7 combined in this manner are accommodated within the case 1. This assembling process is performed as the following: as shown in FIGS. 1, 2, and 4, the driving member 7 with the returning means 6 attached to the lower side thereof is pushed down into the case 1 first using the grooves 1*k* and 1*m* of the case 1 as guides into which the protruded portions 7*c* of the driving member 7 have been fitted; thereby the spring portions 6*c* of the returning means 6 are urged in contact with the bottom wall 1*a*; and when the driving member 7 is further pushed down against the springing properties of the spring portions 6*c*, and the protruded portions 7*c* agree with the retaining portions 1*g* and 1*h*, the protruded portions 7*c* extend outside to be retained by the retaining portions 1*g* and 1*h*, so that the driving member 7 and the returning means 6 are attached to the case 1.

The assembled driving member 7 is usually pressed upwardly by the returning means 6 and is movable in the vertical direction within the retaining portions 1*g* and 1*h* which are elongated holes, while being tiltable about the protruded portions 7*c* as supporting points.

When the driving member 7 is assembled, the three protruded portions 7*a* formed on the bottom wall portion 7*b* oppose the respective movable contacts 5 of the switches S1, S2, and S3, as shown in FIG. 1, so that each of protruded portions 7*a* can drive the respective movable contacts 5.

There is provided with a rotatively-operated electronic component "R" such as a rotary switch, a rotary encoder. This rotatively-operated electronic component "R" is formed such that a rotational body 8 is rotatably assembled within the recess portion 2*a* of the cage 2 integrated with the case 1 while a spring 9 for a detent is accommodated in the accommodating portion 2*b*, and furthermore a cover 10 is attached to the case 1 so as to cover the opened portion of the cage 2.

The rotational body 8 comprises a non-circular hole 8*a* disposed in the center thereof, concave-convex portions 8*b* for the detent disposed in the outer periphery thereof, and plural movable contacts 8*c*. The rotational body 8 is assembled into the cage 2 in the state that the hole 8*a* opposes the hole 2*c* of the cage 2. The concave-convex portions 8*b* are urged in contact with the spring 9 for the detent so that the rotation of the rotational body 8 is moderated.

In the synthetic-resin-molded cover 10, a fixed contact 10*a* is embedded to be touched by the movable contacts 8*c*, such that switching of the contact is derived outside through the fixed contact 10*a*.

When the case 1 serves as the cage 2 for the rotatively-operated electronic component "R" in common in this manner, the number of parts is reduced so that reduced cost and improved efficiency in assembling can be achieved. However, a unitized rotatively-operated electronic component "R" may be used to be attached to the case 1.

A cylindrical operation member 11 formed of moldings of a synthetic resin, etc., comprises nicked portions 11*a* formed on the outer peripheral surface thereof, a through-hole 11*b* formed in the cylindrical axis direction, a non-circular retaining portion 11*c* formed in the intermediate portion of the axis direction within the through-hole 11*b*, and annular protruded portions 11*d* disposed in the both ends thereof.

The both sides of the through-hole 11*b* are conical in shape so that diameters thereof increase gradually toward outsides from the retaining portion 11*c* as a boundary.

In addition, the through-hole 11*b* may have the same diameter other than the smaller retaining portion 11*c*.

A non-circular shaft member 12 formed of a metal, etc., having a cross-section of a rectangle, an oval, etc., comprises a non-circular roundish one end portion 12*a*, a non-circular intermediate portion 12*b*, and the other end portion 12*c* which is a smaller diameter protruded portion made by forming a step.

This shaft member 12 is inserted into the through-hole 11*b* of the operation member 11 from the other end portion 12*c* side to be a state that the other end portion 12*c* passes through the through-hole 11*c*.

At this time, the non-circular intermediate portion 12*b* of the shaft member 12 agrees with the non-circular retaining portion llc of the operation member 11, enabling the rotational operation of the operation member 11 to be transmitted to the shaft member 12.

The assembling process of the shaft member 12 and the operation member 11 combined in this manner in the case 1 is as follows: the one end portion 12*a* of the shaft member 12 is passed through the hole 2*c* of the cage 2 first to be retained in the non-circular hole 8a of the rotational body 8 in the state that the returning means 6 and the driving member 7 are assembled in the case 1; in the next place, when the operation member 11 and the shaft member 12 are pushed into the case 1 in the state that the protruded portions 11*d* of the operation member 11 are arranged above the bearing portions 7*e* of the driving member 7 while the other end portion 12*c* of the shaft member 12 is located above the elongated hole 1*f* of the side wall 1*c*, the other end portion 12*c* of the shaft member 12 bends the side wall 1*c* outside to agree with the elongated hole 1*f* so that the other end portion 12*c* fits into the elongated hole 1*f* while the protruded portions 11*d* of the operation member 11 are to be urged in contact with the arc-shaped bearing portions 7*e* of the driving member 7.

At this time, the operation member 11 is pressed upwardly by a pair of the bearing portions 7*e* of the driving member 7 elastically pressed by the returning means 6 to thereby press the shaft member 12 upwardly, so that the other end portion 12*c* is to be urged in contact with the top end of the elongated hole 1*f* and the shaft member 12 is arranged in parallel with the bottom wall 1*a*.

Consequently, the operation member 11 is rotatable about the shaft member 12 as a rotation axis while being movable against springing properties of the returning means 6 in the direction indicated by the arrow H1 (see FIG. 5) which is substantially perpendicular to the rotation axis and also being tiltable about retaining portion 11*c* as a supporting point.

When the operation member 11 is moved in a direction substantially perpendicular to the rotational direction, the shaft member 12 is to be tilted about the one end portion 12*a* retained in the hole 8*a* of the rotational body 8 as a supporting point while the other end portion 12*c* moves downwardly within the elongated hole 1*f*.

In addition, the structure for retaining the one end portion 12*a* of the shaft member 12 in the hole 8*a* of the rotational body 8 may be gearing combination of gear-like concave-convex portions having relief portions in the axis direction.

In the multi-input switch assembled in this manner, the rotatively-operated electronic component "R" is arranged in the rotational direction of the operation member 11 while the switches S1, S2, and S3 are arranged to oppose the operation member 11 in the direction orthogonal to the rotation axis of the operation member 11.

The operation of the multi-input switch formed as described above will now be described with reference to FIGS. 1, 5, 6, and 7.

In FIG. 1, when the operation member 11 is rotated about the shaft member 12 as a rotation axis first, the shaft member 12 is rotated.

Thereby, the rotational body 8 of the rotatively-operated electronic component "R" retained in the one end portion 12*a* of the shaft member 12 rotates with clicking feeling by the concave-convex portions 8*b* and the spring 9 for a detent while the fixed contact 10*a* is contacted with and separated from the movable contacts 8*c* for switching the contact to operate the rotatively-operated electronic component "R".

As shown in FIG. 5, when the center of the operation member 11 is pressed in the direction indicated by the arrow H1 which is substantially perpendicular to the rotation axis of the operation member 11, it is moved downwardly accompanying the driving member 7 against springing properties of the returning means 6.

Thereby, the rather longish protruded portion 7*a* in the center presses the movable contact 5 of the first switch S1 located in the center so that the movable contact 5 turns over so as to contact the contact 4 connecting the fixed contact 3 to the contact 4 for switching the contact to "ON".

At this time, the shaft member 12 is to be tilted about the one end portion 12*a* retained in the hole 8*a* of the rotational body 8 as a supporting point while the other end portion 12*c* moves downwardly within the elongated hole 1*f*.

When the pressing of the operation member 11 in the direction of the arrow H1 is retracted, the driving member 6, the operation member 11, and the shaft member 12 are returned to the original positions by the returning means 6 and the pressing to the movable contact 5 by the protruded portion 7*a* is also retracted, so that the movable contact 5 turns over to the original state switching the switch S1 to "OFF".

Next, as shown in FIG. 6, the right side portion from the center of the operation member 11 (the side closer to the side wall 1*c*) is pressed in the direction indicated by the arrow H2 which is substantially perpendicular to the rotation axis of the operation member 11, the operation member 11 is to be tilted about the retaining portion llc as a supporting point while the driving member 7 is also tilted about the protruded portions 7*c* as supporting points against springing properties of the returning means 6, so that the protruded portion 7*a* in the right side moves downwardly.

Thereby, the rather short protruded portion 7*a* on the right presses the movable contact 5 of ,the second switch S2 located in the right so that the movable contact 5 turns over so as to contact the contact 4 connecting the fixed contact 3 to the contact 4 for switching the contact to "ON".

At this time, the shaft member 12 is not tilted and maintains the parallel state.

When the pressing of the operation member 11 in the direction of the arrow H2 is retracted, the driving member 6 and the operation member 11 are returned to the original positions by the returning means 6 and the pressing to the movable contact 5 by the protruded portion 7*a* is also retracted, so that the movable contact 5 turns over to the original state switching the switch S2 to "OFF".

Next, as shown in FIG. 7, the left side portion from the center of the operation member 11 (the side closer to the side wall 1*b*) is pressed in the direction indicated by the arrow H3 which is substantially perpendicular to the rotation axis of the operation member 11, just like described above, the operation member 11 is to be tilted about the retaining portion 11*c* as a supporting point while the driving member 7 is also tilted about the protruded portions 7*c* as supporting points against springing properties of the returning means 6, so that the protruded portion 7*a* in the left side moves downwardly.

Thereby, the rather short protruded portion 7*a* on the left presses the movable contact 5 of the third switch S3 located in the left so that the movable contact 5 turns over so as to contact the contact 4 connecting the fixed contact 3 to the contact 4 for switching the contact to "ON".

At this time, the shaft member 12 is not tilted and maintains the parallel state.

Next, when the pressing of the operation member 11 in the direction of the arrow H3 is retracted, the driving member 6 and the operation member 11 are returned to the original positions by the returning means 6 and the pressing to the movable contact 5 by the protruded portion 7*a* is also retracted, so that the movable contact 5 turns over to the original state switching the switch S3 to "OFF".

By the operation described above, switching of numerous switches can be performed. When the multi-input switch is used for radios, for example, the rotatively-operated electronic component "R" is used for manual tuning and S1 is used to memorize the tuned station. Also, S2 is used for auto-tuning by increasing the frequency and S1 is used to memorize the tuned station while S3 is used for auto-tuning by decreasing the frequency and S1 is used to memorize the tuned station.

Figure 12:
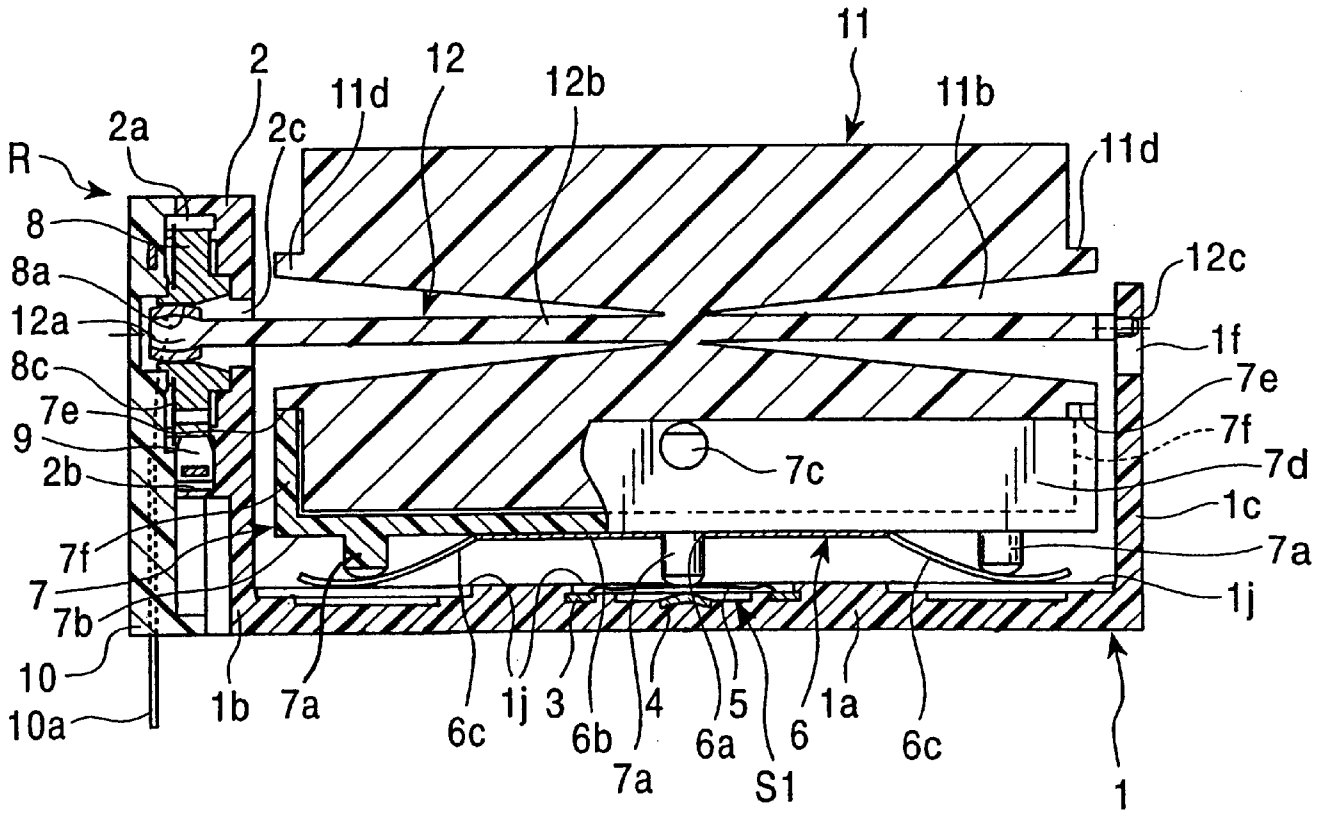
FIG. 12 is a front sectional view of an essential part of another multi-input switch according to the present invention.

The above mentioned embodiment shows the switches S1, S2 and S3. Another embodiment as shown in FIG. 12 is a multi-input switch which has only one switch S1. In this embodiment, a shaft member 12 and an operation member 11 may be formed as a single component so that the shaft member 12 is retained at a center portion of the operation member 11.

In the multi-input switch according to the present invention, the rotatively-operated electronic component is arranged in the direction of the rotation axis of the operation member while switches are arranged in the direction perpendicular to it. By the rotational movement of the operation member, the rotatively-operated electronic component is operated via the shaft member while by the perpendicular movement of the operation member, the shaft is tilted to operate the switches, so that the entire rotatively-operated electronic component does not move to improve the space-saving factor enabling the switch to be miniaturized.

Since the entire rotatively-operated electronic component does not move, the resilient contact arm and the fixed terminal like in the conventional one are not to be required, resulting in increasing the life and reducing manufacturing cost.

In the direction of the rotation axis of the operation member having a through-hole formed so that the both sides thereof are conical-shaped, the rotatively-operated electronic component is arranged, and plural switches are arranged in the perpendicular direction to it. By the rotational movement of the operation member, the rotatively-operated electronic component is operated via the shaft member while by the perpendicular movement of the operation member, one of the plural switches is operated, and furthermore, by the tilting movement of the operation member, another one of the plural switches is operated. Therefore, the entire rotatively-operated electronic component does not move to improve the space-saving factor enabling the switch to be miniaturized.

Since the entire rotatively-operated electronic component does not move, the resilient contact arm and the fixed terminal like in the conventional one are not to be required, resulting in increasing the life and reducing manufacturing cost.

By forming the through-hole of the operation member to be conical-shaped, the shaft member can be easily inserted into the retaining portion, so that assembling efficiency is improved enabling the switch to be inexpensive due to the improved productivity. Thereby, any of plural switches can be turned "on" or "off" by the tilting movement in accordance with the pushing position. This enables the multi-input switch to operate numerous switches, resulting in being applicable to various apparatuses.

By arranging the driving member between the operation member and the switches, the movement of the operation member can be transmitted to the driving member, which is a different part, giving freedom of choice in arranging switches, etc., so that a versatile switch can be obtained while the multi-input switch capable of performing tilting movement can be provided.

Since the other end portion of the shaft member is supported by the elongated hole of the case, any other part for supporting it is not required, so that an inexpensive switch with improved assembling efficiency can be provided.

Furthermore, returning means for returning the driving member and the operation member is provided, so that switching operation of switches is reliable and the multi-input switch capable of performing stable operations can be provided.

What is claimed is:

1. A multi-input switch comprising:

an operation member rotatable and movable in a substantially perpendicular direction to a rotation axis of said operation member;

a rotatively-operated electronic component arranged in the direction of the rotation axis of said operation member;

a switch arranged in the direction perpendicular to the rotation axis of said operation member; and a shaft member inserted into a center potion of said operation member to be retained in a retaining portion of said operation member while one end portion of said shaft member is retained in a rotational body of said rotatively-operated electronic component, wherein said rotatively-operated electronic component is operated via said shaft member by the rotational movement of said operation member and said first switch is operated by the perpendicular movement of said operation member, and wherein said shaft member is tiltable about the one end portion retained in the rotational body of said rotatively-operated electronic component as a supporting point.

2. A multi-input switch comprising:

an operation member having a through-hole formed so that the both sides of a retaining portion of the through-hole are conical-shaped, said operation member being rotatable and movable in a substantially perpendicular direction to a rotation axis of said operation member and also being tiltable about the retaining portion of the through-hole;

a rotatively-operated electronic component arranged in the direction of the rotation axis of said operation member;

a plurality of switches arranged so as to oppose said operation member in the direction perpendicular to the rotation axis of said operation member;

a shaft member inserted into the through-hole of said operation member to be retained in the retaining portion while one end portion of said shaft member is retained in a rotational body of said rotatively-operated electronic component, wherein said rotatively-operated electronic component is operated via said shaft member by the rotational movement of said operation member and any one of said plurality of switches is operated by the perpendicular movement of said operation member, and wherein another one of said plurality of switches is operated by the tilting movement of said operating member.

3. A multi-input switch according to claim 1, further comprising a driving member disposed between said operation member and said first switch, said driving member being movable by the perpendicular movement of said operation member, wherein said first switch is operated via said driving member.

4. A multi-input switch according to claim 1, further comprising a case having an elongated groove, wherein the other end portion of said shaft member is inserted into the elongated groove of said case to be supported.

5. A multi-input switch according to claim 3, further comprising returning means for returning the movement of said driving member while said operation member being held by said driving member.

* * * * *